US006686891B2

(12) United States Patent
McCandless

(10) Patent No.: US 6,686,891 B2
(45) Date of Patent: Feb. 3, 2004

(54) SYSTEM AND METHOD FOR A CENTER FED REFLECTOR FEED FOR A PARABOLIC ANTENNA

(75) Inventor: Jay McCandless, Bellevue, WA (US)

(73) Assignee: BWA Technology, Inc., Las Vegas, NV (US)

( * ) Notice: Subject to any disclaimer, the term of this patent is extended or adjusted under 35 U.S.C. 154(b) by 0 days.

(21) Appl. No.: 10/162,660

(22) Filed: Jun. 6, 2002

(65) Prior Publication Data

US 2003/0227418 A1 Dec. 11, 2003

(51) Int. Cl.[7] ..... H01Q 13/00
(52) U.S. Cl. ..... 343/775; 343/772

(58) Field of Search ..... 343/772, 775, 343/779, 786, 840

(56) References Cited

U.S. PATENT DOCUMENTS 2,489,865 A * 11/1949 Cutler ..... 343/779
2,729,817 A * 1/1956 Cornbleet ..... 343/779

* cited by examiner

*Primary Examiner*—Hoang V. Nguyen
(74) *Attorney, Agent, or Firm*—Duane Morris LLP

(57) ABSTRACT

A system and method for a center fed reflector feed for a parabolic antenna where the feed is configured to include an output portion that is curved in two directions to thereby enhance the E and H plane patterns of the signal directed rearwardly towards a parabolic reflector.

38 Claims, 1 Drawing Sheet

SYSTEM AND METHOD FOR A CENTER FED REFLECTOR FEED FOR A PARABOLIC ANTENNA

BACKGROUND OF THE INVENTION

The present invention relates to a system and method for a microwave antenna feed for a parabolic reflector. More specifically, the present invention relates to a system and method for a center fed, parabolic reflector feed with enhanced electric ("E") and magnetic ("H") plane patterns.

In general, a waveguide is utilized to direct a high-frequency electromagnetic signal rearwardly toward a parabolic reflector for forward reflection. Common reflectors include the two-reflector Cassagrain system in which a horn shaped waveguide directs the signal away forwardly to a sub-reflector from which the signal is directed rearwardly towards the main parabolic reflector for forward reflection. Back-feed, center waveguide systems are also common in which the horn directs the signal rearwardly and directly onto the parabolic reflector for forward reflection.

The signal transmission path from the center of the main reflector is the most important region of the path for obtaining a desired radiation pattern. If there are physical obstructions in this transmission path, an undesirable radiation pattern with side lobes may result. Inherent in the design of the Cassagrain antenna is the problem that the energy transmitted from the main parabolic reflector is blocked by the sub-reflector, and in turn substantial side lobes are generally created. Side lobes also may be formed when there is an uncontrolled destructive combination of two waves or improper control of the E and H plane patterns.

One known back-feed antenna feed system includes a waveguide which has a cap at the distal end for directing the signal rearwardly towards the parabolic reflector from which the waveguide extends. There is generally less obstruction of the transmission path by the cap as compared with a sub-reflector, but waveguide caps generally do not allow for good control and balancing of the E and H plane patterns. Proper control of the E and H plane patterns to avoid large side lobes requires careful placement of the cap with respect to the end of the waveguide and performance problems generally arise because the structurally required proximity of the cap to the waveguide removes the option of strategically locating the cap to control the E and H plane patterns.

Another known back-feed antenna feed system uses a center waveguide bent so as to point toward the parabolic reflector from which it extends. This configuration generally allows for the balancing of E and H plane patterns; however, the obstruction caused by the waveguide geometry generally creates substantial side lobes.

It is also known to split a single waveguide of an antenna feed system into two waveguides that collectively direct an electromagnetic signal rearwardly towards the main reflector. A conventional apparatus with such dual output waveguides is disclosed in U.S. Pat. No. 2,824,305 and includes an input waveguide of rectangular shape that connects to a rectangular head which defines two output waveguides that are substantially parallel to the input waveguide and are of substantially rectangular shape. In such systems, the waveguide is located in the center of the parabolic reflector and the head obstructs the transmission path resulting in a radiation pattern with significant side lobes. In addition, there are two distinctly separate beams of electromagnetic energy directed towards the parabolic reflector; the effects of a point source illuminating the parabolic reflector with a single beam of electromagnetic energy cannot be replicated by such a waveguide.

Accordingly, it is an object of the present invention to obviate many of the above problems in the known systems and to provide a novel system and method for a center fed reflector feed with enhanced E and H plane patterns.

It is another object of the present invention to provide a novel center fed reflector feed apparatus and method with reduced obstruction of the transmitted signal by the waveguide.

It is yet another object of the present invention to provide a novel center fed reflector feed apparatus and method that matches the impedance between a single input waveguide and dual output waveguides.

It is still another object of the present invention to provide a novel center fed reflector feed apparatus and method that matches the impedance between the waveguide and free space.

It is a further object of the present invention to provide a novel dual waveguide center fed reflector feed apparatus and method that generates an improved radiation pattern.

These and many other objects and advantages of the present invention will be readily apparent to one skilled in the art to which the invention pertains from a perusal of the claims, the appended drawings, and the following detailed description of the preferred embodiment.

DESCRIPTION OF PREFERRED EMBODIMENTS

Figure 1:
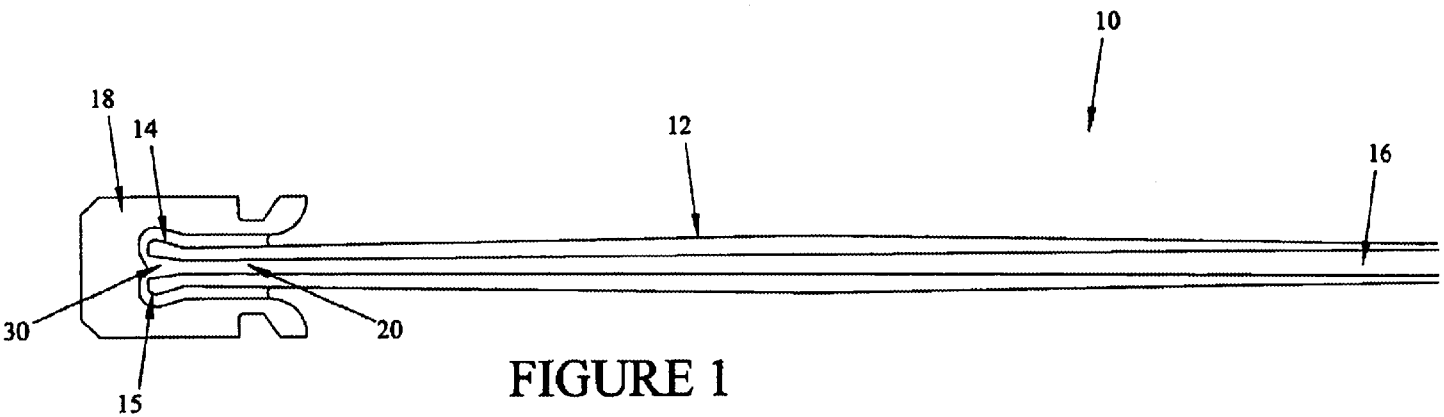
FIG. 1 is a top plan view of one embodiment of the center fed reflector feed in longitudinal cross-section showing the tapering of the input waveguide and the choke and tongue components of the output waveguides.

With reference to the drawings, where like numerals represent like components, the proximate end 16 of the input portion 12 of the waveguide 10 receives the electromagnetic signal from a source located behind the parabolic reflector. The distal end of the input portion 12 extends into the head 18 where it is divided into two output portions 14, 15.

As shown in FIG. 1, the input portion 12 is tapered over the length thereof so as to reduce the obstruction to the transmission path, the narrowest portion 20 of the waveguide 10 having a cross-sectional area approximately equal to one half of the cross-sectional area of the widest portion of the input portion 12 at the proximate end 16 of the waveguide 10. Furthermore, by tapering the input portion 12 the distance between the output portions 14, 15 is reduced and the dual electromagnetic beams emitted from the output portions 14, 15 are sufficiently close together to approximately reproduce the effects of a point source illuminating the parabolic reflector with a single beam of electromagnetic energy.

Immediately after the narrowest portion 20, the input portion 12 of the waveguide is gradually expanded to achieve a cross-sectional area 30 equivalent to the cross-sectional area of the proximate end 16 of the input waveguide 12. The input portion 12 is divided into two generally U-shaped output portions 14, 15. Expanding the input portion 12 before splitting into two output portions 14, 15 effectively matches the impedance between the single input portion 12 and the dual output portions 14, 15 reducing the loss of electromagnetic energy and the size of the side lobes within the radiation pattern.

Figure 2:
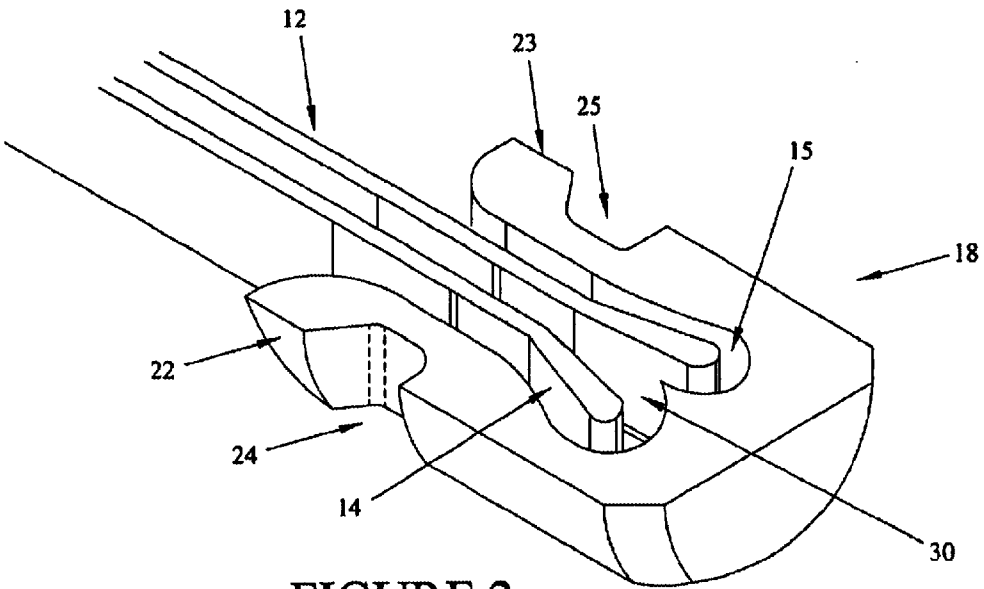
FIG. 2 is an enlarged pictorial view of the head of the reflector feed of FIG. 1.

FIG. 2 provides an enlarged view of the head 18 of the waveguide 10 where the tapered and expanded portions of the input waveguide 12 are more clearly illustrated. In addition, the U-shape of the output portions 14, 15 may be more readily seen.

As shown in FIG. 2, suitable conventional chokes 24, 25 located intermediate the length of the output portions 14, 15 on the outside of the head 18 are provided to improve the E and H plane pattern for the electromagnetic energy directed towards the parabolic reflector. There is often a small amount of energy that is emitted from the output waveguides 14, 15 into free space that does not radiate rearwardly towards the parabolic reflector, but radiates forwardly away from the reflector. The chokes 24, 25 couple the forwardly radiating energy and re-direct such energy rearwardly towards to the parabolic reflector. When the re-directed signal unites with the original signal radiating towards the parabolic reflector the phases in the E-field of each signal are such that the amplitude of the combined E-field signal is tapered from the center of the parabolic reflector to the edge of the parabolic reflector. In turn, the side lobes of the resultant radiation pattern are improved.

With continued reference to FIG. 2, the termination of the output portion includes tongues 22, 23 which are smoothly curved in both the E plane and H plane, the E plane curve being approximately one third of the free space wavelength of the transmitted signal. The smooth curves of the tongues 22, 23 effectively match the impedance between the output portions 14, 15, respectively, and free space over a very broad band, for example, over a bandwidth that is approximately thirty-five percent of the center frequency of the transmitted signal. For example, if the center frequency of the transmitted signal is 29 GHz, the bandwidth would be approximately 10 GHz (i.e., 29 GHz * 0.35=10.15). Therefore, the bandwidth would include frequencies up to approximately 5 GHz lower than the center frequency and frequencies up to approximately 5 GHz greater than the center frequency. Specifically, the bandwidth would be approximately 24 GHz to 34 GHz for a transmitted signal with 29 GHz center frequency. By effectively matching the impedance of free space, a negligible amount of electromagnetic energy is reflected and the resultant radiation pattern has reduced side lobes.

While preferred embodiments of the present invention have been described, it is to be understood that the embodiments described are illustrative only and that the scope of the invention is to be defined solely by the appended claims when accorded a full range of equivalence, many variations and modifications naturally occurring to those of skill in the art from a perusal hereof.

What is claimed is:

1. An antenna waveguide feed for a parabolic reflector comprising an input and an output portion, said input portion of the waveguide being tapered in the direction of signal travel from a maximum cross-sectional area to about one half of the maximum cross-sectional area to thereby reduce interference of the signal directed to and reflected from the reflector, and then gradually increasing in cross-sectional area to said maximum cross-sectional area to thereby improve the impedance match between said input and output portions; and said output portion joining said input portion and directing the received signal to the parabolic reflector, said output portion including a plurality of generally U-shaped channels each having a choke intermediate the length thereof to thereby generate an enhanced radiation pattern and a tongue at the free end thereof to thereby improve the impedance match between the output section and free space.

2. The antenna waveguide feed of claim 1 wherein said plurality of generally U-shaped channels is two.

3. The antenna waveguide feed of claim 2 wherein the ratio between the cross sectional area of the narrowest section of the input portion to the cross sectional area of one of said two U-shaped channels is 1:1.

4. The antenna waveguide feed of claim 1 wherein each tongue is curved in the H and E planes.

5. The antenna waveguide feed of claim 4 wherein the radius of said E plane curve is about one third of the free space wavelength of the transmitted signal.

6. The antenna waveguide feed of claim 5 wherein the radius of said H plane curve is about one third of the free space wavelength of the transmitted signal.

7. The antenna waveguide feed of claim 1 wherein said output portion comprises:

a height aligned with an E plane of said input waveguide; and a width aligned with an H plane of said input waveguide, wherein an ability to independently establish said height and said width enable control and coordination of E and H plane distributions to thereby generate enhanced radiation and reception patterns.

8. The antenna waveguide feed of claim 1 wherein the height of said input portion is tapered in the direction of signal travel from a maximum height to about one half of the maximum height to thereby reduce the cross-sectional area of said input portion to about one half of the maximum cross-sectional area.

9. The antenna waveguide feed of claim 1, wherein said tongue effectively matches the impedance between said output portion and free space over a bandwidth that is approximately thirty-five percent of the center frequency of the transmitted signal.

10. The antenna waveguide feed of claim 9, wherein said bandwidth includes frequencies approximately ten to twenty percent lower than the center frequency of the transmitted signal and frequencies approximately ten to twenty percent greater than the center frequency of the transmitted signal.

11. The antenna waveguide feed of claim 9, wherein said bandwidth includes frequencies approximately fifteen to twenty percent lower than the center frequency of the transmitted signal and frequencies approximately fifteen to twenty percent greater than the center frequency of the transmitted signal.

12. The antenna waveguide feed of claim 9, wherein said bandwidth includes frequencies approximately 17.5 percent lower than the center frequency of the transmitted signal and frequencies approximately 17.5 percent greater than the center frequency of the transmitted signal.

13. A method of feeding a parabolic reflector comprising the steps of:

(a) receiving a signal in a first waveguide having a gradually reducing cross-sectional area for reducing interference of the signal directed to and reflected from the parabolic reflector;

(b) passing the received signal through a second waveguide having a gradually increasing cross-sectional area for effectively matching the impedance between said second waveguide and a plurality of feeds;

(c) splitting the passed signal into a plurality of feeds;

(d) directing the split signal from the feeds onto a parabolic reflector past a choke configured to assist in generating an enhanced radiation pattern and a tongue configured so that the impedance of the feed effectively matches the impedance of free space.

14. A method of feeding a parabolic reflector comprising the steps of:

(a) receiving a first signal in a first waveguide section having a gradually decreasing cross-sectional area;

(b) producing a plurality of second signals from said first signal in a second waveguide section wherein said second waveguide section includes a portion with a gradually increasing cross-sectional area for matching the impedance between said second waveguide section and free space; and (c) directing said plurality of second signals out of said second waveguide section and through said free space towards said parabolic reflector to thereby feed said parabolic reflector.

15. The method of claim 14 whereby said second waveguide section includes a choke.

16. In a method of matching impedance between free space and an output portion of a waveguide in which a signal is received by an input portion, split into a plurality of output portions and directed from each of said plurality of output portions onto the parabolic reflector, improvement wherein the signal is directed towards the parabolic reflector through output portions that include a tongue.

17. The method of claim 16 wherein said tongue is curved in the E and H planes.

18. The method of claim 17 wherein the radius of said E plane curve is about one third of the free space wavelength of the transmitted signal.

19. The method of claim 18 wherein the radius of said H plane curve is about one third of the free space wavelength of the transmitted signal.

20. The method of claim 17, wherein said tongue effectively matches the impedance between said output portion and free space over a bandwidth that is approximately thirty-five percent of the center frequency of the transmitted signal.

21. The method of claim 20, wherein said bandwidth includes frequencies approximately ten to twenty percent lower than the center frequency of the transmitted signal and frequencies approximately ten to twenty percent greater than the center frequency of the transmitted signal.

22. The method of claim 20, wherein said bandwidth includes frequencies approximately fifteen to twenty percent lower than the center frequency of the transmitted signal and frequencies approximately fifteen to twenty percent greater than the center frequency of the transmitted signal.

23. The method of claim 20, wherein said bandwidth includes frequencies approximately 17.5 percent lower than the center frequency of the transmitted signal and frequencies approximately 17.5 percent greater than the center frequency of the transmitted signal.

24. In a method for generating an enhanced radiation pattern from an antenna waveguide in which a signal is received by an input portion, split into two output portions and directed from each of said outputs onto the parabolic reflector, the improvement wherein the signal is directed towards the parabolic reflector through output portions that include a choke.

25. In a method of matching impedance between an input portion and an output portion within an antenna waveguide in which a signal is received by an input portion, split into a plurality of output portions and directed from each of said plurality of output portions onto the parabolic reflector, the improvement wherein the signal is received in an input portion having a gradually increasing cross-sectional area prior to said plurality of output portions.

26. In an antenna waveguide feed for a parabolic reflector comprising an input portion for receiving a signal and an output portion for directing the received signal to a parabolic reflector, said output portion having a plurality of generally U-shaped channels, the improvement wherein the cross-sectional area of said input portion is gradually increased prior to joining said output portion to thereby effectively match the impedance between said input and output portions.

27. In an antenna waveguide feed for a parabolic reflector comprising an input portion for receiving a signal and an output portion for directing the received signal to a parabolic reflector, said output portion having a plurality of generally U-shaped channels, the improvement wherein each of said generally U-shaped channels includes a tongue to thereby effectively match the impedance between said generally U-shaped channels and free space.

28. In an antenna waveguide feed for a parabolic reflector comprising an input portion for receiving a signal and an output portion for directing the received signal to a parabolic reflector, said output portion having a plurality of generally U-shaped channels, the improvement wherein each of said generally U-shaped channels includes a choke to thereby generate an enhanced radiation pattern.

29. In an antenna system including a parabolic reflector in which a signal is received by a waveguide, split into a plurality of feeds and directed from said plurality of feeds onto the parabolic reflector, the improvement wherein said waveguide includes a gradually decreasing cross-sectional area preceding a gradually increasing cross-sectional area.

30. An antenna waveguide feed for a parabolic reflector comprising an input and an output portion, said input portion of the waveguide being tapered inwardly in the direction of signal travel then tapered outwardly in the direction of signal travel to thereby improve the impedance match between said input and output portions.

31. An antenna waveguide feed for a parabolic reflector comprising an input portion and a plurality of output portions, wherein a signal is received by said input portion and split into said plurality of output portions onto said parabolic reflector, wherein each of said plurality of output portions includes a choke.

32. An antenna waveguide feed for a parabolic reflector comprising an input portion and a plurality of output portions, wherein a signal is received by said input portion and split into said plurality of output portions onto said parabolic reflector, wherein each of said plurality of output portions includes a tongue.

33. An antenna waveguide feed for a parabolic reflector comprising an input portion and an output portion including a plurality of generally U-shaped channels each having a choke to thereby generate an enhanced radiation pattern for the parabolic reflector.

34. The antenna waveguide feed of claim 33 wherein said output portion further includes a tongue at the free end thereof to thereby reduce the impedance mismatch between the output section and free space.

35. An antenna waveguide feed for a parabolic reflector comprising an input and an output portion wherein said output portion directs a signal in said waveguide towards the parabolic reflector, and wherein said output portion includes a plurality of generally U-shaped channels and a tongue at the free end thereof to thereby improve the impedance match between the output section and free space.

36. The antenna waveguide feed of claim 35 wherein said tongue is curved in at least one of the E and H planes.

37. The antenna waveguide feed of claim 35 wherein the radius of said tongue in the E plane is about one third of the free space wavelength of said signal.

38. The antenna waveguide feed of claim 35 wherein the radius of said tongue in the H plane is about one third of the free space wavelength of said signal.

* * * * *